United States Patent [19]

Sen-Yi

[11] 4,446,604

[45] May 8, 1984

[54] WRIST BRACELET CLASP

[76] Inventor: Lin Sen-Yi, No. 32, Alley 60, Lane 288, Yu Nung Rd., Tainan, Taiwan

[21] Appl. No.: 364,409

[22] Filed: Apr. 1, 1982

[51] Int. Cl.[3] ..... A44B 21/00

[52] U.S. Cl. ..... 24/68 J; 24/71 J; 24/188; 24/265 WS

[58] Field of Search ..... 24/188, 189, 191, 192, 24/248 R, 248 B, 170, 68 E, 371, 347, 68 J, 71 J, 265 WS, 265 BC, 265 EC

[56] References Cited

U.S. PATENT DOCUMENTS

| | | | |
|---|---|---|---|
| 438,912 | 10/1890 | Day | 24/170 |
| 508,970 | 11/1893 | Pasztor | 24/311 |
| 1,701,041 | 2/1929 | Johnson et al. | 24/71 J |
| 3,636,596 | 1/1972 | Iizuka | 24/191 |
| 3,665,564 | 5/1972 | Oka | 24/265 WS |
| 3,797,716 | 3/1974 | Mochizuki | 24/265 WS |
| 4,330,905 | 5/1982 | Wolfgang | 24/71 J |
| 4,359,808 | 11/1982 | Fontaine | 24/71 J |

FOREIGN PATENT DOCUMENTS

| | | | |
|---|---|---|---|
| 2369809 | 7/1978 | France | 24/265 WS |

*Primary Examiner*—Gene Mancene
*Assistant Examiner*—David I. Tarnoff
*Attorney, Agent, or Firm*—Larson and Taylor

[57] ABSTRACT

A clasp for a wrist bracelet comprises upper and lower pivotally interconnected plates. Flanges are provided for connecting the upper plate to one end of a wrist bracelet and the free end of the bracelet is selectively received between a pivotally mounted locking plate and the lower plate. The plates are movable between a spaced apart or open position wherein the free end of the bracelet may be slid freely beneath the locking plate, thereby allowing a wearer to obtain a comfortable fit, and a locked position wherein the plates are pressed together and the locking plate is actuated so as to restrain further movement of the free end of the bracelet.

8 Claims, 6 Drawing Figures

WRIST BRACELET CLASP

This invention relates to a clasp for a wrist bracelet such as a metal watch strap.

The object of the invention is to provide a clasp which allows a substantially inelastic wrist bracelet, in particular a metal watch strap, to readily accommodate large or small wrist sizes without the need of any permanent adjustment to the bracelet or to the clasp.

According to the invention there is provided a clasp for a wrist bracelet comprising first and second pivotally connected, substantially rigid arms, means for connecting said clasp to one end of a bracelet, said first arm being provided with means for freely receiving therethrough a selectively variable length of the other end of the bracelet and a locking member adapted to lockingly engage said other end when a desired length has been passed through said receiving means, said locking member being actuated by pivotal movement of said arms from a first, spaced apart, position to a second, substantially coextensive position, said arms being releasably held in said second position by catch means.

Thus, in use, the correct effective length of the bracelet is chosen simply by wrapping the bracelet around the wrist and, with the clasp in the unlocked position, pushing the free end of the bracelet through the receiving means, for example an opening defined between the locking member and the first arm until a comfortable fit is obtained. The second arm is then moved to the second position wherein the locking member is actuated and further movement of the free end of the bracelet through the opening is restrained and, thus, the bracelet is firmly secured round the wrist. In a preferred embodiment the first arm comprises an elongate base plate provided with upwardly projecting sidewalls between which extends a transverse pin vertically spaced from the elongate base plate. The locking member advantageously comprises a locking plate which is pivotally mounted on the pin and which has a downwardly projecting flange along one edge thereof. The sidewalls, locking plate and elongate plate thus define a substantially rectangular opening adpted to receive the free end of the bracelet. An inclined opening is conveniently provided in the elongate base plate behind the locking plate. Thus, as more of the bracelet is pushed into the clasp through the receiving means, the free end of the bracelet emerges from the clasp through the inclined opening so as to be received in a space formed between the catch the wearer's wrist.

Preferably, the catch means comprises a downwardly projecting hook portion mounted on the second arm which is adapted to selectively engage the transverse pin carried by the first arm. In the locked position the second arm is firmly pressed against the first arm so that the hook portion clips round the transverse pin; the second arm engages the locking member and cause it to pivot so that the flange thereof is pressed tightly aginst the free end of the bracelet.

The first arm of the bracelet may be conveniently secured to the second arm by means of a pin.

Advantageously, the first arm is additionally provided with one or more tabs projecting upwardly from the elongate plate and disposed beneath the locking plate. Thus, in the locked position the free end of the bracelet is tightly pressed against the tabs and movement of the bracelet through the clasp is further restrained. The tabs are particularly advantageous if the clasp is to be used with a metal watch strap comprising a plurality of individual bars or like members. In this case the tabs may extend into the gaps between the bars and engage the edges of one or more of the bars. Preferably, both the arms are generally curved along their lengths so as to fit comfortably over a wrist.

A preferred embodiment of the invention will now be described, by way of example only, with reference to the accompanying drawings in which.

Figure 1:
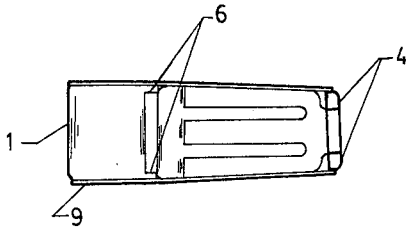
FIG. 1 is a plan view from above of a wrist bracelet clasp in accordance with the invention in the locked position.
Figure 3:
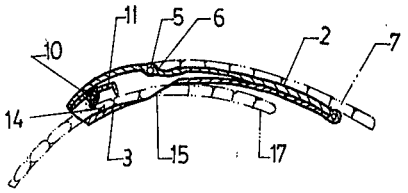
FIG. 3 is a view similar to FIG. 2 showing the clasp in use with a wrist bracelet and in the locked position.

Referring to the drawings, a wrist bracelet clasp 1 comprises two pivotally interconnected substantially rigid arms in the form of an upper plate 2 and an elongate base plate 3; the plates 2,3 are preferably formed from stainless steel and are generally curved along their length so as to lie comfortably on the wrist of the wearer. The plates 2,3 are hingedly connected at one end by pivot means, here a conventional hinge pin 4. The upper plate 2 is formed with a stepped portion 5 towards its free end and two small flanges 6 are disposed adjacent the stepped portion. The flanges 6 each have a small hole formed therein and, as shown in FIG. 3, one end 7 of a wrist bracelet, for example a metal watch strap, may be secured thereto by means of a pin extending between flanges 6. Thus, the end 7 of the strap lies adjacent the step portion and the upper surface of the strap is flush with the upper surface of the free end of the plate 2. The free end of the plate 2 is additionally provided with a downwardly projecting hook portion 8 on its under side.

The base plate 3 is formed with upwardly projecting side walls 9 along its longitudinal edges. A transverse pin 10 disposed towards the free end of the lower plate and upwardly spaced thereform is secured to and extends between the side walls 9. The pin is connected to a locking member comprising a locking plate 11 having a downwardly projecting flange 12 along the rear edge thereof is pivotally mounted on the pin 10. A substantially rectangular opening **11*a* is thus defined between the locking plate 11, the side walls 9 and the base plate 3. A slot 13 of similar width to the hook portion 8 of the upper plate 2 is formed in the locking plate 11 adjacent the pin 10. The base plate 3 is additionally provided with two small tabs 14 substantially normal to the base plate 3 and projecting toward the locking plate. The base plate 3 is divided longitudinally by an inclined opening 15 located intermediate the ends of base plate 3 which extends between the sidewalls 9 across the plate 3**.

Figure 2:
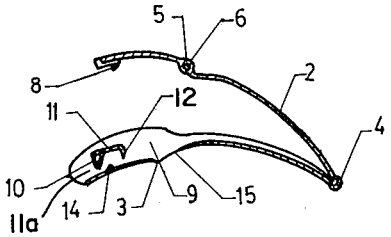
FIG. 2 is a side elevation of the clasp of Figure in an unlocked position.
Figure 4:
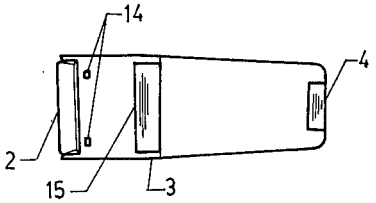
FIG. 4 is a plan view from below of the bracelet clasp shown in FIG. 1.
Figure 5:
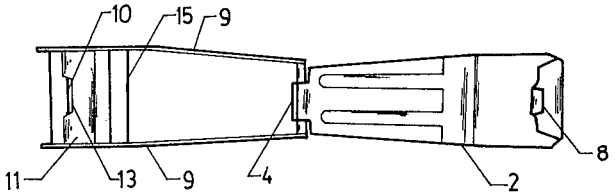
FIG. 5 is a view similar to FIG. 2 showing the clasp in use with a wrist bracelet and in the unlocked or open position.
Figure 6:
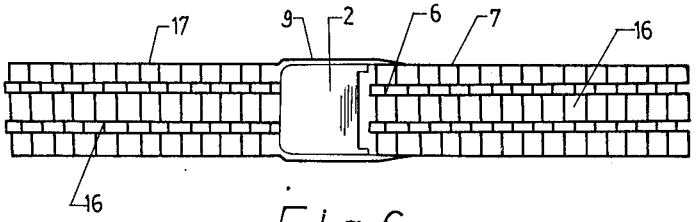
FIG. 6 is a view similar to FIG. 1 showing the clasp in use with a wrist bracelet and in the locked position.

The use of the clasp 1 with a wrist bracelet or metal watch strap comprising a plurality of individual bars 16 or like members will now be described with particular reference to FIGS. 2 and 3. The first end 7 of the bracelet is permanently secured to the upper plate 1 as previously described. The bracelet is then wrapped round the wearer's wrist and, with the clasp in the open, unlocked position in which the arms are spaced apart as shown in FIG. 2, the free end 17 of the bracelet is passed between the side walls 9 of the base plate 3 through the opening defined by the base plate 3 and the locking plate 11; the bracelet is then pushed further into the clasp 1 until the free end 17 emerges from the inclined opening 15 formed in the base plate. The effective length of the bracelet may therefore be selected in accordance with the size of the wearer's wrist simply by pushing the appropriate length of bracelet through the opening 15 so that the bracelet is suitably tight.

Once a snug fit is obtained, the clasp is locked simply by pushing the upper plate 2 firmly against the base plate 3 so that the plates are in close adjacency and the hook-portion 8 of the upper plate passes through the slot 13 in the locking plate 11 and clips round the transverse pin 10 carried by the side walls, as shown in FIG. 3.

In this position the plates 2, 3 are clipped together and the upper plate 2 engages the locking plate 11 and urges the flange 12 thereof towards the base plate 3 so that the free end 17 of the bracelet becomes tightly clamped between the flange 12 and the base plate 3. The free end 17 of the bracelet is prevented from sliding out of the clasp 1 when it is in the locked position by the upwardly projecting tabs 14 of the base plate 3. The bracelet is firmly pressed onto the tabs 14 by the flange 12 and the tabs 14 engage the edge of one of the bars 16 or like members of the bracelet. Thus, a substantially inelastic wrist bracelet or metal watch strap may be readily adapted to accommodate large or small wrists without the need to any permanent adjustment to the strap or the fastening clasp.

I claim:

1. A clasp for a wrist bracelet, said wrist bracelet having first and second ends, said clasp comprising:

a first arm having an elongate base plate, upstanding flanges on either side of said base plate at a first end thereof, and an opening through said base plate intermediate said first end and a second end thereof, said opening being adapted to receive therethrough a first end of a wrist bracelet;

a second arm having a stepped portion and a base portion at first and second ends thereof, a downwardly projecting hook portion mounted at said first end of said second arm and thus at the end of said stepped portion, and upstanding flanges on either sides of said base portion at the junction thereof with said stepped portion, said second arm flanges being adapted to mount a second end of a wrist bracelet;

pivot means for pivotally connecting said second ends of said arms so that said first and second arms are pivotable between an open position in which said first ends of said arms are spaced apart and a closed position in which said first ends of said arms are in close adjacency, said hook portion for releasably securing said first ends of said arms in said closed position; and locking means on said first arm at a location remote from said pivot means, said opening being located intermediate said locking means and said pivot means, said locking means comprising a pivotable locking member spaced vertically from said base plate such that a first end of a wrist bracelet may be passed freely between said locking member and said base plate, and said locking means comprising a catch means for mating securing engagement with said hook portion, said opening through said base plate being positioned such that the first end of the wrist bracelet, after being passed between said locking member and said base plate, may pass freely through said opening, said locking member being actuated by said hook portion upon pivotal movement of said first and second arms to said closed position to releasably secure a first end of a wrist bracelet to said first arm.

2. A clasp as claimed in claim 1 wherein said locking means further includes a mounting pin transversely mounted between said flanges on said first arm; and wherein said locking member is pivotably mounted on said mounting pin.

3. A clasp as claimed in claim 2 wherein said locking member includes a slot therein, said slot located so as to expose a portion of said mounting pin, and said catch means comprising said exposed mounting pin portion.

4. A clasp as claimed in claim 1 wherein said pivot means comprises a pin.

5. A clasp as claimed in claim 1 wherein said first and second arms are generally curved along their lengths.

6. A clasp as claimed in claim 1 wherein said locking means comprises a tab projecting from said base plate toward said locking member at an angle substantially normal to said base plate.

7. A clasp as claimed in claim 6 wherein said locking member includes a hinge portion, mounted on said mounting pin, a base portion integral with said hinge portion and extending in the direction towards said pivot means so as to overlie said tab, and a downwardly extending flange portion for engaging the wrist bracelet when the wrist bracelet has been passed between said locking member and said base plate.

8. A clasp as claimed in claim 1 wherein said opening is an inclined opening with respect to said base plate.

* * * * *